US006435348B1

(12) United States Patent
Pasquesi

(10) Patent No.: US 6,435,348 B1
(45) Date of Patent: Aug. 20, 2002

(54) CUSHIONED CONTAINER ASSEMBLY

(76) Inventor: John Pasquesi, 563 Ivy Ct., Lake Forest, IL (US) 60045

( * ) Notice: Subject to any disclaimer, the term of this patent is extended or adjusted under 35 U.S.C. 154(b) by 0 days.

(21) Appl. No.: 09/731,546

(22) Filed: Dec. 8, 2000

(51) Int. Cl.[7] ..... B65D 85/67
(52) U.S. Cl. ..... 206/390; 206/522; 206/524.8
(58) Field of Search ..... 206/521, 522, 206/524.8, 390; 383/3; 428/34.3, 43, 906

(56) References Cited

U.S. PATENT DOCUMENTS 4,155,453 A * 5/1979 Ono ..... 206/522
4,190,158 A * 2/1980 Ambrose ..... 206/522
4,267,684 A * 5/1981 Ambrose ..... 206/583
4,465,188 A * 8/1984 Soroka et al. ..... 206/521
5,651,327 A * 7/1997 Whitener ..... 114/258

* cited by examiner

*Primary Examiner*—David T. Fidei
(74) *Attorney, Agent, or Firm*—Hamman & Benn; Jack Shore

(57) ABSTRACT

This novel cushioned container consists of an inner tube in which an item is located and concentric outer tube resiliently connected to the inner tube. The inner tube is evacuated by a hose located therein after which the hose is closed off. The outer tube is then inflated by a hose to provide a cushioning chamber surrounding the enclosed item. The hose connected to the outer chamber is then closed off to prevent air from leaving the cushioning chamber.

3 Claims, 1 Drawing Sheet

FIG. 1
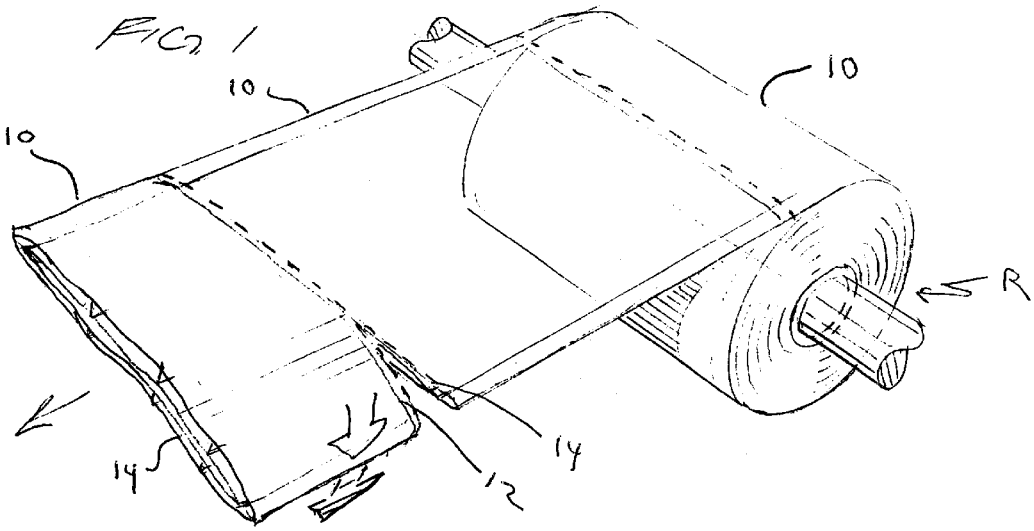
FIG. 3
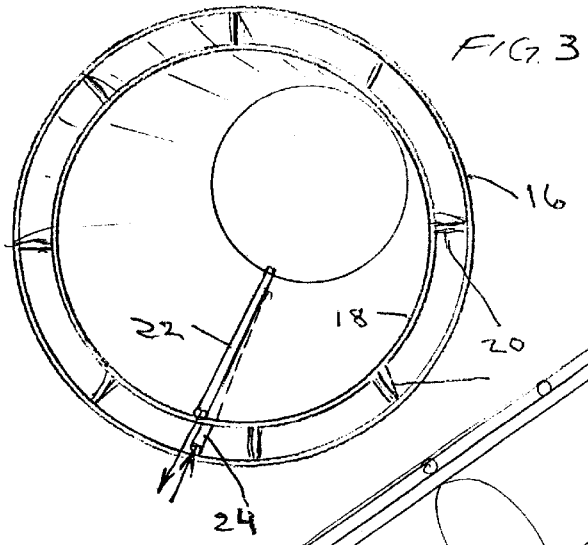
FIG. 2
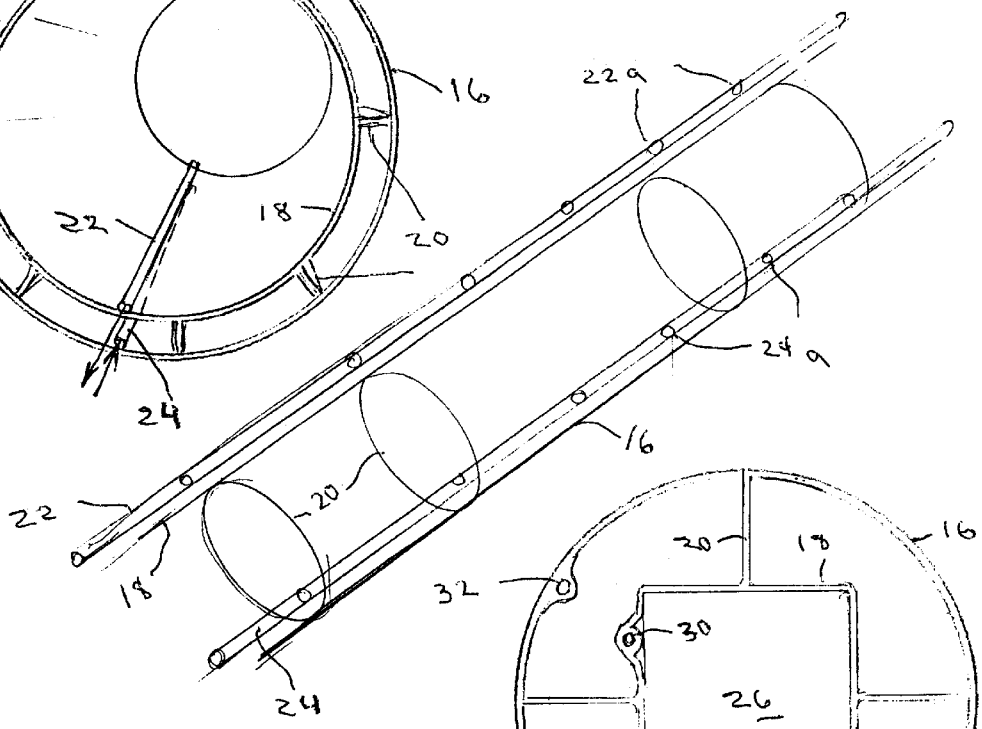
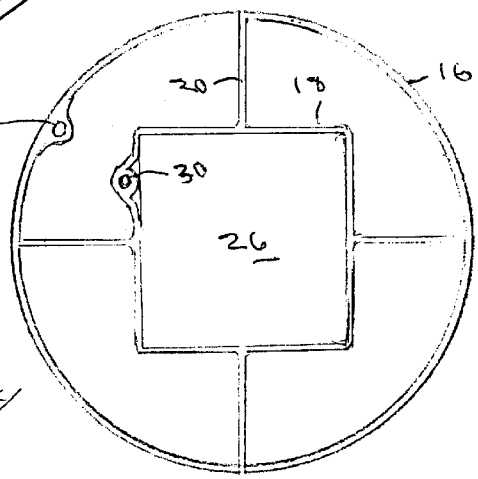
FIG. 4

CUSHIONED CONTAINER ASSEMBLY

FIELD OF THE INVENTION

This invention relates to the packaging of various items in a cushioned environment, particularly to such items that may be fragile and shipped long distances requiring that the contents not be damaged during transport.

BACKGROUND OF THE INVENTION

There have been various ways for packaging items. These include the common use of Styrofoam or paper fragments as a cushioning medium. There has also been used a cushioning product known as "bubble pack" which consists of a series of bubbles containing air under pressure that function to cushion the package during shipment. These items have worked reasonably well but have been somewhat expensive and do not readily lend themselves to being used by those companies that do not package a large number of items. These common types of cushioning mediums also requires a somewhat large storage area to contain the bubble pack or Styrofoam or other solid materials that are to be used when packaging.

SUMMARY OF THE INVENTION

In accordance with the present invention there is provided a very novel, unique and easy to use packaging arrangement that will provide a cushioned environment for an item to be packaged. The packaging material can consist of very simple and readily available plastic tubes that can be stored on a roll or the like and thus requires very little storage space for a very large quantity of cushioning material. Essentially, the invention consists of inner and outer packaging configurations in which the inner chamber consists of a plastic tube that holds the contents is initially expanded to receive the contents and then evacuated to positively locate of the item within the container assembly. Surrounding the inner container is an outer container which in the preferred embodiment also consists of a plastic tube that is connected by resilient connectors to the inner tube. The inner tube is provided with a hose that can be used to evacuate the inner chamber forming a vacuum which disposes the inner chamber wall closely around the item disposed therein. The outer tube is similarly provided with a hose which hose can be used to inflate the outer tube and thereby provide a cushioning environment about the inner tube and item packaged therein. Both tubes are then sealed off to prevent either air from being introduced into the inner chamber and thus providing for a loose package or from air escaping from the outer container to reduce the cushioning effect.

BRIEF DESCRIPTION OF THE DRAWINGS

In the accompanying drawings forming a part of the specification in which like numerals are employed to designate like parts throughout;

FIG. 1 illustrate a plurality of containers disposed on a roll;

FIG. 2 is a perspective view showing the inner and outer tube in expanded condition prior to receiving the contents to be packaged therein;

FIG. 3 is a partial trasverse sectional view of the container assembly taken along line 3—3 in FIG. 2; and FIG. 4 is a cross sectional view showing the inner tube collapsed about the contents and the outer tube inflated to cushion the contents during transport.

DETAILED DESCRIPTION OF THE DRAWINGS

In FIG. 1 there is illustrated a roll R of container assemblies 10. The container 10 in a preferred embodiment is constructed of a flexible plastic and the end of each container is sealed at 12 and leaves an exposed open end 14 into which an item can be introduced and cushioned in a manner disclosed hereinafter.

In FIG. 2 a container assembly 10 has been severed from the roll and is shown in an expanded open condition prior to receiving the contents to be stored and cushioned. The far end 15 is sealed. The assembly consists of an outer tube 16 and an inner tube 18 that are joined by flexible connectors 20 secured to and located between the inner and outer tubes.

We now refer to FIGS. 2 and 3 that illustrate the various components by which the invention provides for a novel cushioned container. The inner tube 18 is provided with a hose 22 disposal parallel to and secured to the inner wall of the inner tube and extends outwardly of the tube assemblage for facilitating evacuation of the inner tube by any suitable means. The outer tube is also provided with a hose 24 that is disposed parallel to and secured to the inner wall of tube 16 thereof to facilitate inflation thereof by any suitable means. The hose 24 also extends outwardly of the tube assemblage. After an item 26 is located within the inner tube 18, the assemblage including the tubes and the open end of the container assembly is then sealed off at it its open end by suitable sealing mechanisms that are well known in the trade. The concentric tubes are initially located on a roll R and the size of the container is pre-determined. The hoses 22, 24 are provided with spaced openings 22*a*, 24*a* that facilitate evacuating air from the inner tube and filling the outer tube with air.

Referring now to FIG. 4 there shown the cushioned container which includes the contents 28 located in the inner tube 18 that has been evacuated to tightly wrap the inner tube 18 around the contents 26 and the outer tube 16 has been expanded to provide the desired cushioning effect.

It is also noted that there is illustrated a removal plug 30 that is used to close off the hose 22 leading to the inner tube 18 after it has been evacuated and a removable plug 32 for closing off the hose 24 leading to outer tube 16 after it has been filled.

It can be appreciated that there is shown a very simple construction for providing a cushioned assembly for a package to be shipped.

METHOD OF OPERATION

The inner and outer tube assemblage is removed from a roll R with one end sealed and the hoses 22, 24 extending outwardly of the open end 14. An item 26 is placed within the inner tube 18 and the open end of the hose 22 is used for evacuating air from the inner tube 18. Air is evacuated from the inner tube 18 by a conventional vacuum drawing arrangement thus drawing the inner tube 18 about the item packaged therein as shown in FIG. 4. Hose 22 is then sealed off at its open end by the removable plug 30. After this is completed the hose 24 for inflating the outer tube 16 is used to fill the outer tube to provide the cushioning chamber surrounding the inner tube. Hose 24 is closed by a removable plug 32. We have thus provided a unique, simple and inexpensive cushioned container containing an item therein for shipping which will not be damaged in transport.

It should, of course, be appreciated from the foregoing detailed description of the invention of the illustrative embodiment thereof that numerous variations and modifications may be affected without departing from the true spirit and scope and novel concepts of the principals of the invention.

What is claimed is:

1. A roll of cushioned container assemblies in which each container assembly consists of a sealed inner chamber defined by a flexible sheet for receiving an item to be shipped, means for evacuating said inner chamber to dispose said flexible sheet about said item, an outer flexible sheet disposed about said inner flexible sheet to define an outer chamber therebetween and connected thereto said sheets consisting of air impermeable plastic materials, said inner and outer chambers consisting of inner and outer concentric tubes that are connected together at spaced areas around their circumference and means for filling said outer chamber to form a cushion for said items to provide for shipping said item without damaging same.

2. A roll of cushioned containers as set forth in claim 1 in which the inner tube is provided with an accessible air outlet hose secured to its inner wall whereby the inner chamber can be evacuated to locate the flexible sheet defining the inner chamber about an item and the outer tube includes an accessible air hose for filling up the outer tube to provide an air cushion for the packaged item.

3. A cushioned container assembly as set forth in claim 2 in which the inlet and outlet hoses are provided with openings at spaced points so that any length container can be formed and means for plugging up the hoses after the inner chamber has been evacuated and the outer cushioning chamber filled.

* * * * *